US007032488B2

(12) United States Patent
Höpner et al.

(10) Patent No.: US 7,032,488 B2
(45) Date of Patent: Apr. 25, 2006

(54) DEVICE FOR SUPPORTING A MATERIAL WEB

(75) Inventors: Bernd Höpner, Pinneberg (DE); Thomas Hitscher, Hamburg (DE)

(73) Assignee: E.C.H. Will GmbH, Hamburg (DE)

( * ) Notice: Subject to any disclaimer, the term of this patent is extended or adjusted under 35 U.S.C. 154(b) by 0 days.

(21) Appl. No.: 10/365,386

(22) Filed: Feb. 13, 2003

(65) Prior Publication Data

US 2003/0150310 A1 Aug. 14, 2003

(30) Foreign Application Priority Data

Feb. 14, 2002 (DE) ..... 102 06 323

(51) Int. Cl.
*B26D 7/06* (2006.01)

(52) U.S. Cl. ..... 83/436.3; 83/156; 83/302; 83/346; 83/425; 198/679; 226/194; 242/525.6; 384/549

(58) Field of Classification Search ..... 83/438, 83/495, 436.3, 436.1, 436.15, 443, 444, 448, 83/949, 156, 162, 302, 346, 425; 158/722, 158/624, 679; 242/525.6, 525.7; 384/549; 198/722, 624, 679; 226/189, 181, 190, 194
See application file for complete search history.

(56) References Cited

U.S. PATENT DOCUMENTS 2,593,388 A 4/1952 Littman
3,338,109 A * 8/1967 Forsyth et al. ..... 74/410
3,353,880 A * 11/1967 Silver ..... 384/549
3,836,103 A * 9/1974 Retali et al. ..... 248/130
3,936,100 A * 2/1976 Moores et al. ..... 384/215
3,949,948 A * 4/1976 Tomma ..... 242/525.5
4,092,886 A * 6/1978 Nowisch ..... 83/56
4,128,280 A * 12/1978 Purtschert ..... 384/107
4,416,492 A * 11/1983 Singletary ..... 384/126
4,422,587 A 12/1983 Primich
4,895,315 A 1/1990 Salmela et al.
4,976,766 A * 12/1990 Kuster et al. ..... 65/289
5,072,638 A * 12/1991 Huser ..... 83/24
5,657,526 A * 8/1997 Yatcko ..... 29/416
5,836,500 A * 11/1998 Jourde ..... 226/189
5,913,470 A * 6/1999 Scribner ..... 226/90
6,444,093 B1 * 9/2002 Luomi et al. ..... 162/202

FOREIGN PATENT DOCUMENTS

DE 28 21 956 11/1979
DE 39 06 376 9/1990

* cited by examiner

*Primary Examiner*—Allan N. Shoap
*Assistant Examiner*—Phong Nguyen
(74) *Attorney, Agent, or Firm*—Robert Kinberg; Venable LLP

(57) ABSTRACT

A support for a material web for use with a longitudinal cutting device for cutting the material web, includes a support shaft having an axis of rotation. At least one bearing mechanism positions the at least one support shaft, wherein the at least one bearing mechanism has an axis of rotation outside of the axis of rotation of the support shaft.

29 Claims, 3 Drawing Sheets

DEVICE FOR SUPPORTING A MATERIAL WEB

CROSS-REFERENCE TO RELATED APPLICATION

This application claims the priority of German Patent Application No. 102 06 323.0 filed Feb. 14, 2002, the disclosure of which, together with the disclosure of each U.S. and foreign patent and patent application mentioned below, is incorporated herein by reference.

BACKGROUND OF THE INVENTION

The invention relates to a support for a material web, especially a paper web, on a cutting device for the material web, in particular a longitudinal cutting device on a machine in the paper-processing industry. The invention furthermore relates to the use of a support of this type, to an arrangement for cutting a material web, especially a paper web, and to a machine in the paper-processing industry.

A format cutter manufactured by the assignee of the present application and marketed under the designation SLK is already known. For this cutter, several paper webs are joined in front of a longitudinal cutting device and are then cut into strips of paper with a predetermined width, for example 210 mm for DIN A 4. The longitudinal cutting device is a stationary longitudinal cutting unit for making a tangential cut.

The longitudinal cutting station for this paper processing machine comprises an upper blade and a lower blade, between which at least one paper web is guided through and is cut into paper strips. German patent DE 28 21 956 C2 and German unexamined published patent application DE 39 06 376 A1 disclose devices for the longitudinal cutting of paper webs.

Several longitudinal cutting blades are used in a parallel, side-by-side arrangement to cut a paper web, wherein the spacing between these cutting blades can determine the format. With the format-flexible longitudinal cutting blades, the paper between the individual longitudinal cutting blade holders cannot be supported since the blades are displaced transverse, that is crosswise to the direction of paper web movement, depending on the format. The paper is tensioned through a very slight looping across the lower blades. Guide rollers are arranged in front of and behind the longitudinal cutting blades. These guide rollers are far removed from the paper cutting location since these rollers generally have a large diameter of up to 150 mm to ensure sufficient stability over the complete working width of the longitudinal cutting device.

The tightly held paper, however, has a tendency to sag in those locations where it is not supported by the lower blades, meaning between the rollers and/or the longitudinal cutting blades. This sag is greater the farther the rollers are removed from the longitudinal cutters and the farther the longitudinal cutters are spaced apart in each case. In addition, spacing the rollers far apart favors the increased formation of folds in the longitudinal direction in the paper webs to be cut.

SUMMARY OF THE INVENTION

Thus, it is an object of the present invention to support the conveyed paper webs on the longitudinal cutting device and to improve the edge retention at the longitudinal cutting blades.

The above and other objects are achieved according to the invention by the provision of a support for a material web for use with a longitudinal cutting device for cutting the material web, comprising: a support shaft having an axis of rotation; and at least one bearing means for positioning the at least one support shaft, the at least one bearing means having an axis of rotation outside of the axis of rotation of the support shaft.

The object of the invention is thus solved first of all in that the support as defined in the above is designed to have at least one support shaft and at least one bearing means for the rotatably positioning the support shaft, wherein the bearing means has an axis of rotation outside of the axis of rotation for the support shaft. The support according to the invention causes the paper web to be supported directly in front of/or behind the cutting location of cutting device, which is normally stationary. The positioning of the support shaft according to the invention makes it possible to use thin shafts since a bending of the shafts caused by the bearing means according to the invention is prevented. By reducing the distance between the support shaft and the cutting location, the support can be arranged in the intake area and/or the discharge area for the cutting device, so that the transverse bending of the material web between the cutting blades is reduced or even prevented. In addition, arranging the support in the intake area and/or the discharge area results in less looping of the material web on the lower blade and the creation of fewer longitudinal folds in the paper web.

Since the bearing means is no longer positioned co-linear with the axis of rotation of the support shaft, it is advantageous if the bearing means is embodied in the form of at least one bearing device that is preferably arranged along the support shaft.

According to one advantageous modification, the bearing device is provided with at least two bearing elements.

It is furthermore advantageous if the bearing device and/or the bearing elements rotate, such that the support shaft can also rotate.

One advantageous modification provides that the bearing device or the bearing elements at least make direct contact with the support shaft, such that the support shaft can roll off the bearing device or the bearing elements.

The bearing elements according to another advantageous modification of the invention are preferably designed to be cylindrical rotating members.

Alternatively, the bearing elements may be advantageously embodied as disc-shaped elements or roller bearings.

The bearing device and/or the bearing elements are furthermore advantageously arranged axially-parallel to the support shaft, preferably in the longitudinal direction of the support shaft and at predetermined distances to each other. As a result, the support shaft is strategically supported at specific locations, for example between the lower blades. The weight of the support shaft is additionally reduced in this way since either, the bearing device or the bearing elements are formed by sectors. Strategically supporting the shaft at several locations along the support shaft prevents bending in the longitudinal direction of the support shaft.

At least one holding device for the support shaft is provided to prevent the shaft from jumping out of the bearing device.

In particular, the holding device advantageously holds the support shaft without making contact, which simplifies the construction.

Advantageously the holding device comprises at least one magnet. The magnetic forces hold the support shaft inside the bearing device so that the support shaft can rotate in the bearing device and/or in the bearing elements.

The invention furthermore provides that holding devices and/or magnets are installed with predetermined spacing along the support shaft.

According to one advantageous embodiment of the invention, at least one holding device is arranged between two bearing devices or at least one bearing device is arranged between two holding devices. An alternating sequence of bearing devices and holding devices is consequently formed, which reliably supports and securely holds the support shaft.

It is furthermore advantageous if at least one supporting structure is provided for supporting the hearing device and/or the holding device, so that the bearing device and/or the holding device together with the support shaft form a compact arrangement. The supporting structure also permits a good positioning of the support in the intake area and the discharge area of the longitudinal cutting blades. The supporting structure furthermore results in a compact design, thus making it easy to replace the support.

According to a further aspect of the invention, there is provided a method of supporting a material web in at least one of an intake area and a discharge area of a longitudinal cutting device for the material web, the method comprising utilizing the support as described above.

According to yet another aspect of the invention, there is provided an arrangement for cutting a material web, especially a paper web. This arrangement comprises at least one cutting device; in particular a longitudinal cutting device, on a machine in the paper processing industry, as well as a support of the type as described in the above.

One modification of the arrangement according to the invention provides that the supporting structure is adjustable, in particular with respect to height. By using an adjustable supporting structure together with the support shaft, the support can be positioned extremely close to the cutting location for the longitudinal cutting device.

According to still another aspect of the invention, there is provided a method of supporting a paper web in a machine in the paper-processing industry, comprising utilizing the support as described above.

BRIEF DESCRIPTION OF THE DRAWINGS

The invention is described in the following without restricting the general inventive idea, with the aid of exemplary embodiments and by referring to the drawings, to which we refer for all details of the invention that are not explicitly explained in the text. Shown are in.

DETAILED DESCRIPTION OF THE INVENTION

In the Figures described herein, the same elements are given the same reference numbers and will not introduced anew in each case.

Figure 1:
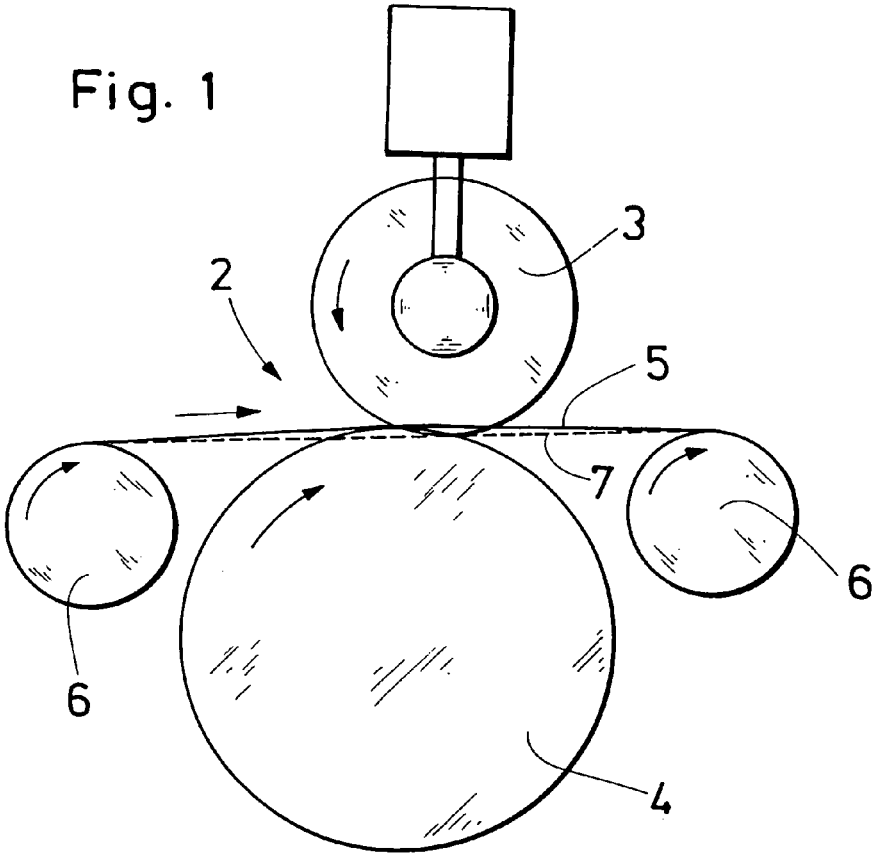
FIG. 1 is known in the prior art.

FIG. 1 shows an arrangement for cutting a paper web 5 in a longitudinal cutting station of a paper-processing machine. The longitudinal cutting station comprises a longitudinal cutting device 2 with an upper knife 3 and a lower knife 4, which make a tangential cut through the paper web that moves between the lower knife and the upper knife.

Respectively one support shaft 6 is arranged in front of the longitudinal cutting device 2 and behind the longitudinal cutting device 2 to support the paper web 5 in transverse direction, meaning in a plane that is perpendicular to the drawing plane. Owing to the width of the paper web 5, it is necessary for the support shafts 6 to have sufficient stability across the complete width of the paper web. For this, the support shafts 6 are designed to have a correspondingly large diameter of up to 150 mm. Based on this large diameter for the support shafts 6, however, these support shafts 6 can only be arranged at a correspondingly large distance to the cutting location of the paper web 5.

To ensure a precise cutting, the paper web 5 must be tensioned with only a very slight looping across the lower knife 4 and other parallel arranged lower knives. The paper 5 that is tensioned in the longitudinal cutting station 2 is not supported between two lower knives in the region of the cutting plane, so that the paper web 5 assumes a direct connection between the support shafts 6. As a result, the paper web sags between the lower knives 4 and the support shafts 6, the sag being depicted by the dashed line 7. The height of the surface curvature depends on the distance between the side-by-side arranged lower knives and the distance between the support shafts in the intake area and/or the discharge area of the longitudinal cutting device 2. A large distance between the support shafts 6 favors the formation of longitudinal folds in the paper web 5. With format-flexible longitudinal cutters this leads to edge-retention problems.

To improve the edge-retention for the longitudinal cutting device 2, the invention therefore provides for supporting the paper web 5 as closely as possible in front of and behind the cutting location. As a result, the sagging or curvature of the paper web 5 between the parallel-arranged lower knives is clearly reduced as compared to the prior art. With some types of paper, it is even possible to completely prevent the sagging of the paper web.

Figure 2:
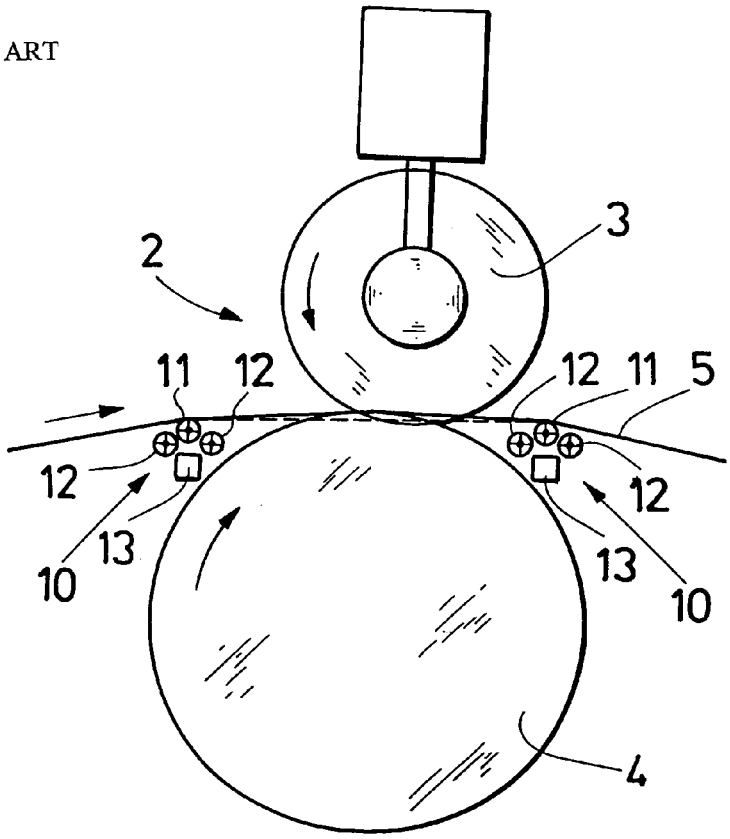
PRIOR ART Fig. 2
FIG. 2 is a cross section through a cutting arrangement according to the invention.

FIG. 2 shows a cross section through a longitudinal cutting device 2 with respectively one support 10 according to the invention for the material web 5 arranged in the intake area and in the discharge area of the paper web 5. The basic design for the support 10 is shown schematically. The support 10 is respectively provided with a support shaft 11, which has the same function as the support shaft 6 in FIG. 1. The support shaft 11 is positioned such that it can rotate with the aid of several bearings devices 12, for example cylindrical bearings, ball bearings or disc bearings, arranged along the support shaft 11. To make sure that the support shaft 11 can rotate inside the support 10, the underside of support 10 is provided with a magnet 13, which holds the support shaft 11 inside the support 10 with the aid of magnetic forces.

In contrast to the prior art, a support shaft with clearly smaller diameter than the support shaft 6 according to the prior art arrangement shown in FIG. 1 can be used since the bearing devices are positioned to rotate about respective axes outside of the axis of rotation of the support shaft 11. In addition, the bearings 12 not only function to position the support shaft 11 so that it can rotate, but also result in a stabilization of the support shaft 11 over the complete working width of the longitudinal cutting device 2. The bearing devices 12 are thus spaced apart by short distance to support the thin support shafts 11 so that the support shaft 11 cannot bend. By using a thin support shaft 11, the distance between the point where the material web 5 rests on the support shaft 11 and the cutting location in the longitudinal cutting device 2 can be shortened noticeably as compared to the known arrangement shown in FIG. 1.

Figure 3:
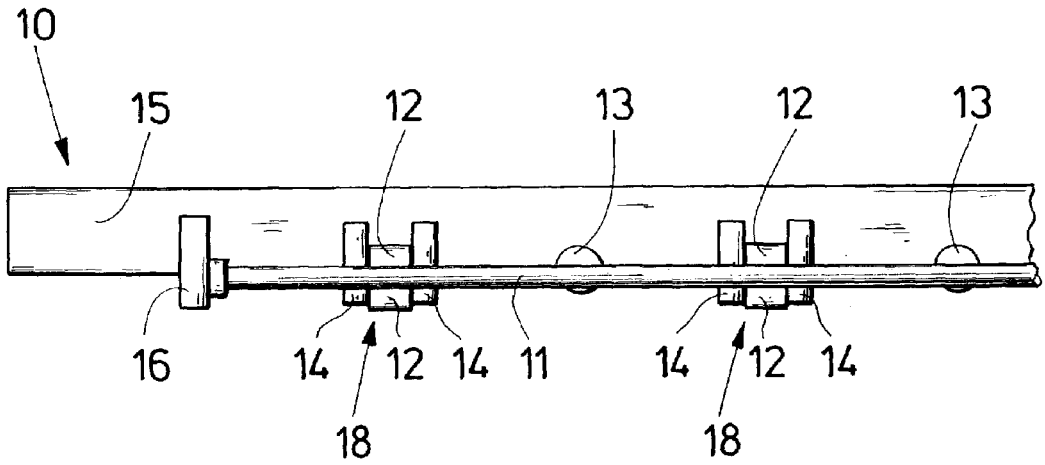
FIG. 3 is a plan view of one of the supports shown in FIG. 2.
Figure 4:
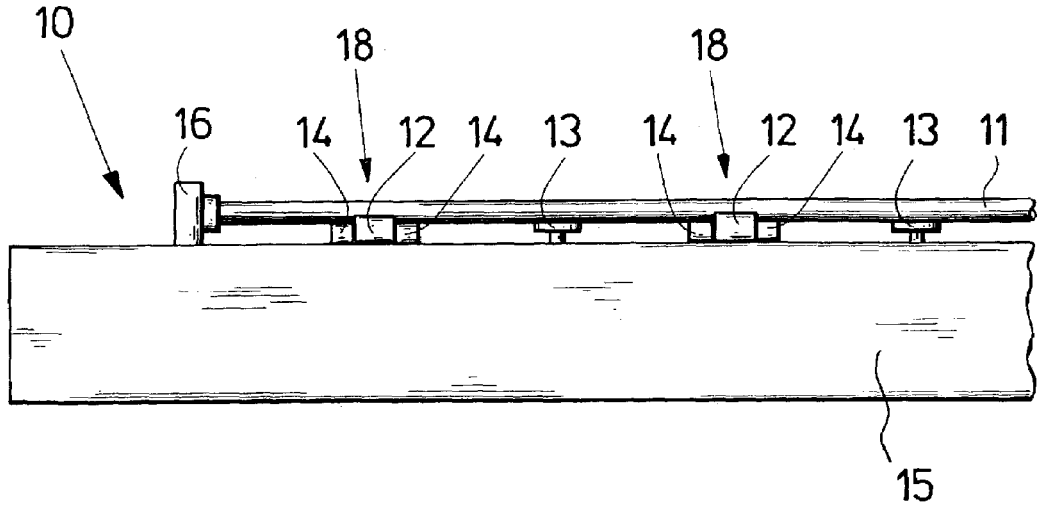
FIG. 4 is a side view of the support shown in FIG. 3.

Sectional details of a support 10 in an embodiment according to the invention are shown in FIG. 3 in a view from above and in FIG. 4 in a view from the side. The support 10 is provided with a transverse bar 15 on which the support shaft 11 is arranged. The support shaft 11 is arranged such that it can rotate on the ball bearings 12. The ball bearings 12 are delimited and held in place on both sides by holders 14, wherein the ball bearings 12 and the holders together form a bearing device 18 for the support shaft 11.

Other embodiments within the scope of the invention, but not illustrated herein, include, for example, disc-shaped rotational elements as bearing devices.

The bearing devices 18 are distributed over the complete length of support shaft 11 spaced apart evenly, to reliably support the support shaft 11. An end holder 16 is mounted on a transverse bar 15 at the end of the support shaft 11 for holding the end of support shaft 11.

Respectively one magnet 13 is arranged between two bearing devices 18, below the support shaft 11. Without making contact, this magnet keeps the support shaft 11 in a position where it makes contact with the bearing devices 12.

With the exemplary embodiment shown herein, respectively only one magnet 13 is arranged between two bearing devices 18 and/or respectively only one bearing device 18 is arranged between two magnets.

Figure 5:
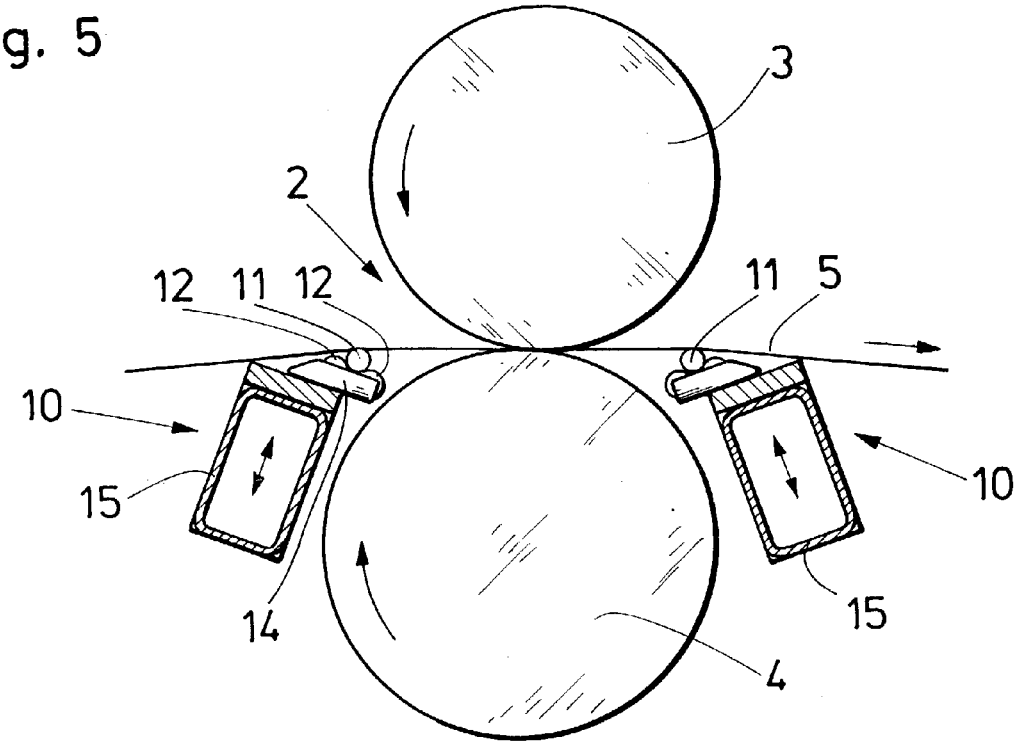
FIG. 5 is a sectional view of a cutting arrangement with supports according to the invention.
Figure 6:
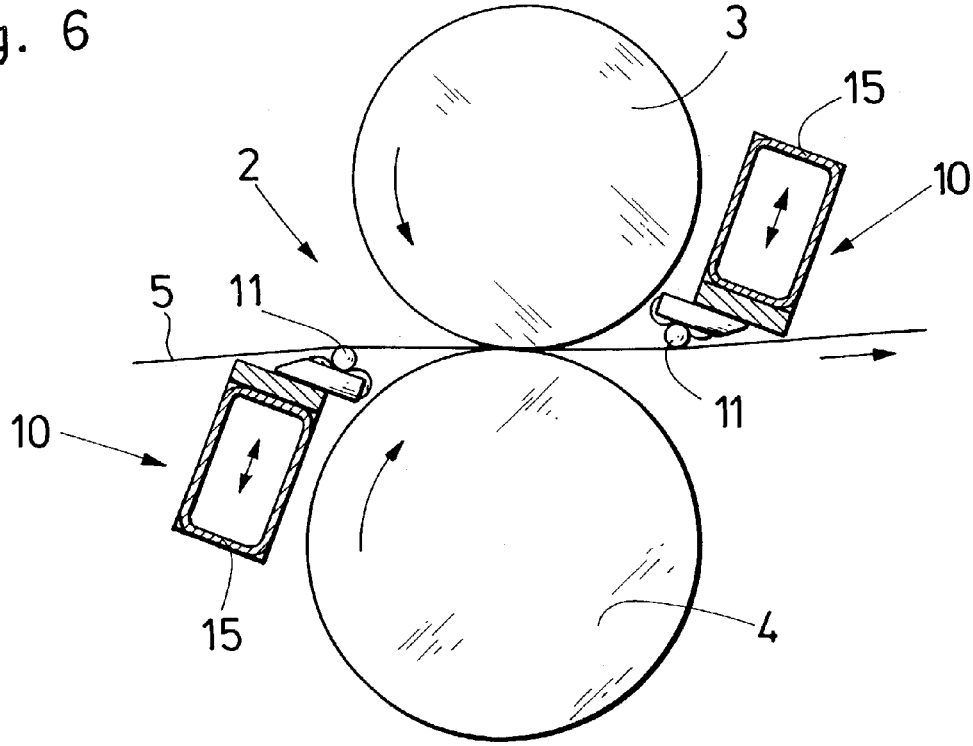
FIG. 6 is a cross-sectional view a cutting arrangement according to another embodiment of the invention.

Longitudinal cutting devices 2 are shown respectively in FIGS. 5 and 6, for which the support 10 according to the invention is arranged in different ways in the intake area and the discharge area. With the cutting arrangement in FIG. 5, the supports 10 are arranged in the intake area and in the discharge area of the cutting arrangement, on the underside of the paper web 5. The height of supports 10 is adjustable, depending on the edge-retention requirements. The support shafts 11 are thus adaptable and important, depending on the types of paper to be cut and the dimensions.

Of course, it is also possible to arrange the supports 10 on both sides of the paper web 5, as shown in FIG. 6.

Owing to the fact that a support shaft 11 with a small diameter and bearing devices 18 are used, which position the support shaft 11 such that it can rotate, the bearing devices 18 are positioned outside of the axis of rotation for the support shaft 11, and in particular, the axes of rotation of the respective bearing elements are parallel to but not co-linear with the axis of rotation of the support shaft 11.

The paper to be cut can thus be supported very close to the locations where the paper is cut in the longitudinal cutting device. As a result, the edge retention of the cut paper material is improved and longitudinal folds in the paper webs are furthermore avoided.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A support for a material web in combination with a longitudinal cutting device for cutting the material web, comprising:

a material web support shaft having an axis of rotation and having an essentially uniform peripheral surface;

end holders adapted to support respective ends of the support shaft;

at least one bearing means for positioning the at least one support shaft, the at least one bearing means having an axis of rotation outside of the axis of rotation of the support shaft; and at least one holding device holding the support shaft on the bearing means and comprising at least one magnet located between the end holders.

2. The support according to claim 1, wherein the at least one bearing means comprises at least one bearing device arranged along the support shaft.

3. The support according to claim 2, wherein the bearing device includes at least two bearing elements.

4. The support according to claim 3, wherein the at least two bearing elements comprise cylindrical rotational elements.

5. The support according to claim 3, wherein the at least two bearing elements comprise one of disc-shaped elements and ball bearings.

6. The support according to claim 2, wherein the at least one bearing device is rotatable.

7. The support according to claim 2, wherein the at least one bearing device at least makes direct contact with the support shaft.

8. The support according to claim 2, wherein the at least one bearing device is arranged axially parallel to the support shaft.

9. The support according to claim 2, wherein the at least one holding device is arranged between two bearing devices.

10. The support according to claim 2, wherein at least one bearing device is arranged between of two of the holding devices.

11. The support according to one of the claim 2, further including at least one supporting structure for supporting at least one of the at least one bearing device and the at least one holding device.

12. The support according to claim 1, wherein the at least one holding device holds the support shaft without making direct contact.

13. The support according to claim 1, wherein the at least one holding device comprise a plurality of holding devices that are arranged at predetermined distances along the support shaft.

14. A method of supporting a material web in at least one of an intake area and a discharge area of a longitudinal cutting device for the material web, comprising utilizing the support according to claim 1.

15. An arrangement for cutting a material web, comprising:

at least one longitudinal cutting device for cutting the material web; and at least one support arranged at least one of upstream and downstream of the cutting device, said at least one support including a material web support shaft having an axis of rotation and having an essentially uniform peripheral surface, end holders adapted to support respective ends of the support shaft, at least one bearing means positioned between the end holders for positioning the at least one support shaft, the at least one bearing means having an axis of rotation outside of the axis of rotation of the support shaft, and at least one holding device comprising at least one magnet located between the at least one bearing means and one of the end holders.

16. The arrangement of claim 15, wherein the at least one support is a single support.

17. The arrangement according to claim 15, wherein the cutting device is a longitudinal cutting device for cutting the material web in a longitudinal direction.

18. The arrangement according to claim 15, wherein the at least one bearing means comprises at least one bearing device arranged along the support shaft.

19. The arrangement according to claim 18, wherein the bearing device includes at least two bearing elements.

20. The arrangement according to claim 19, wherein the at least two bearing elements comprise cylindrical rotational elements.

21. The arrangement according to claim 19, wherein the at least two bearing elements comprise one of disc-shaped elements and ball bearings.

22. The arrangement according to claim 18, wherein the at least one bearing device is rotatable.

23. The arrangement according to claim 18, wherein the at least one bearing device at least makes direct contact with the support shaft.

24. The arrangement according to claim 18, wherein the at least one bearing device is arranged axially parallel to the support shaft.

25. The arrangement according to claim 18, wherein the at least one holding device is arranged between two bearing devices.

26. The arrangement according to the claim 18, further including at least one supporting structure for supporting at least one of the at least one bearing device and the at least one holding device.

27. The arrangement according to claim 18, further including at least two holding devices for holding the support shaft, wherein at least one bearing device is arranged between of two of the holding devices.

28. The arrangement according to claim 15, wherein the at least one holding device comprises a plurality of holding devices that are arranged at predetermined distances along the support shaft.

29. The arrangement according to claim 15, wherein the at least one holding device comprises a plurality of holding devices that are arranged at predetermined distances along the support shaft.

* * * * *